United States Patent [19]

Bohmer

[11] Patent Number: 4,749,296

[45] Date of Patent: Jun. 7, 1988

[54] PLATEN FOR TYPEWRITERS OR SIMILAR MACHINES

[75] Inventor: Christian Bohmer, Nuremberg, Fed. Rep. of Germany

[73] Assignee: TA Triumph-Adler Aktiengesellschaft, Nuremberg, Fed. Rep. of Germany

[21] Appl. No.: 40,836

[22] Filed: Apr. 7, 1987

[30] Foreign Application Priority Data

Apr. 9, 1986 [DE] Fed. Rep. of Germany ..... 3612004

[51] Int. Cl.[4] ..... B41J 11/04

[52] U.S. Cl. ..... 400/659

[58] Field of Search ..... 400/659, 660, 660.1, 400/662

[56] References Cited

U.S. PATENT DOCUMENTS 997,537 7/1911 Berry ..... 400/660 X
4,186,162 1/1980 Daley ..... 400/659 X
4,453,848 6/1984 Adkisson ..... 400/659 X

FOREIGN PATENT DOCUMENTS 0003051 7/1979 European Pat. Off. ..... 400/662
589017 3/1937 Fed. Rep. of Germany .
726476 10/1942 Fed. Rep. of Germany .

*Primary Examiner*—Edgar S. Burr
*Assistant Examiner*—James Lisehora
*Attorney, Agent, or Firm*—Browdy and Neimark

[57] ABSTRACT

A platen for typewriters or similar machines comprising a platen tube with a resilient outer cover and having stub shaft assemblies press fitted into each end. Each assembly comprises a circular end piece having a central bore into which a stub shaft is press fitted, and a circular plate having a central depression into which one end of the stub shaft is press fitted. The arrangement allows for a platen construction of few easily produced parts which can be easily assembled to provide an inexpensive assembly.

3 Claims, 1 Drawing Sheet

PLATEN FOR TYPEWRITERS OR SIMILAR MACHINES

BACKGROUND OF THE INVENTION

1. Field of the invention

This invention relates to platens for typewriters or like machines; more particularly it relates to platens having a covered cylindrical tube and stub shaft assemblies press fitted into the ends thereof; and specifically to a platen in which the stub shaft assemblies are themselves press fitted parts.

2. Related art

A platen of the above kind is known from DE-PS No. 589 017. However, it is necessary there to join the platen end pieces to the platen tube by additional components. Moreover, this known platen requires special measures to join the stub shafts to the platen end pieces firmly. This means considerable costs for parts and assembly. In addition, the platen mass is increased unnecessarily.

Similar drawbacks also apply to a platen disclosed in DE-PS No. 726 476. It needs a through platen shaft because no assembly possibilities for stub shafts are provided at the platen end pieces.

SUMMARY OF THE INVENTION

A platen comprises a hollow cylindrical tube having a resilient outer cover and having stub shaft assemblies press fitted into opposite ends. Each stub shaft assemby also comprises press fitted parts with the stub shafts press fitted into a bore of a platen end piece and a shaft end bearing plate. The bearing plates as well as the platen end pieces of a platen thus designed can be made of plastic by injection molding. Except for cutting it to length and possibly chamfering it, the platen tube needs no further mechanical machining. The platen tube may consist of a metallic material; but it is also possible to provide a glass tube which offers the advantage of great manufacturing accuracy regarding the inside and outside diameters. Platen end pieces are designed according to the invention such that a very good press fit results when the platen end pieces are pressed into the tube. This firm seat exists not only between the platen end pieces and the platen tube, but also between the platen end pieces and stub shafts. Reliable rotation of the stub shafts and platen end pieces as a unit is assured by the non-rotatable engagement of the stub shafts when pressed into the central bore of the platen end piece. Further, the invention allows positioning of the stub shafts with great accuracy relative to each other so that no mechanical machining is required. Furthermore, the bearing points of the stub shafts are far apart, resulting in excellent mounting of the platen.

Due to the simplicity of the assembly, a largely automated production of the platen is imaginable also. The resilient platen cover can be applied and subsequently ground either before or after insertion of the stub shaft assemblies whose assembly can also be automated. Thus, the result is a platen which, overall, is inexpensive and easy to assemble, yet fully meets the strict requirements as to concentricity and noise suppression.

An object of the invention is to provide a platen which consists of the fewest possible parts and which can be produced with great accuracy as well as cheaply.

Another object is in the provision of an easily manufactured and assembled platen having sound suppression characteristics nowadays demanded of such platens.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

DESCRIPTION OF PREFERRED EMBODIMENT

Figure 1:
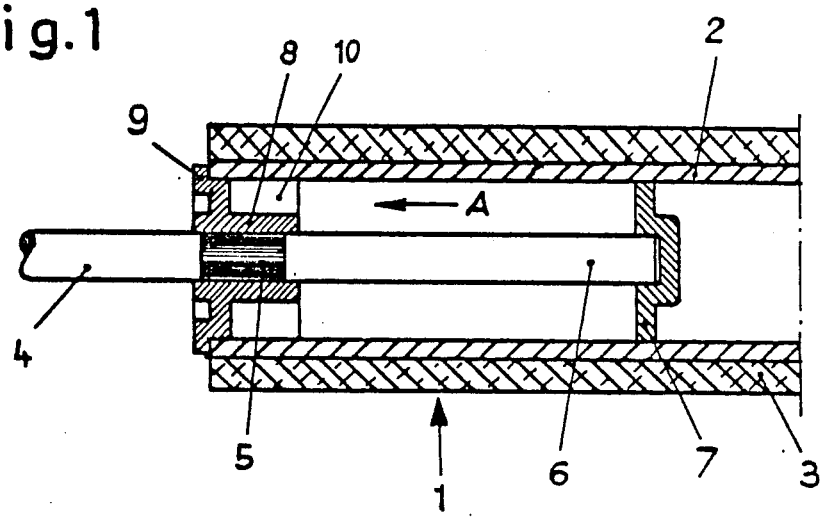
FIG. 1 is a transverse section of a part of a platen.
Figure 2:
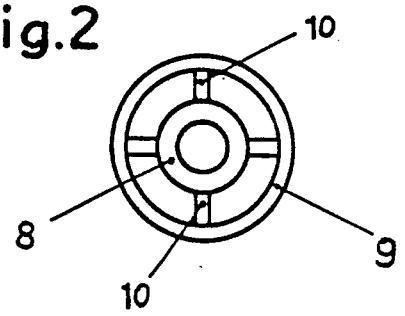
FIG. 2 is a front view of a platen end piece viewed in the direction of arrow A in FIG. 1.

Referring now to the drawing there is shown in FIG. 1 a platen generally designated by reference numeral 1 comprising a cylindrical platen tube 2 and a resilient outer shell or cover 3. Into each end of the tube 2 a stub shaft assembly is press fitted. Each stub shaft assembly comprises a stub shaft 4 having a knurled section 5 with an inner end 6 press fitted into a central cupshaped depression in a circular bearing plate 7. An annular platen end piece 8 has a central bore and at its outside end a circular flange 9. The inside end of the platen end piece 8 has, with reference to FIGS. 1 and 2, at least four radially projecting webs 10 which when pressed into the platen tube 2 bear against the inside wall of the platen tube 2.

To assemble the platen the stub shaft ends which will later project into the platen 1 are pushed through the central bore of platen end pieces 8 and then pressed into the central depression of the bearing plate 7. These stub shaft assemblies are then introduced in the platen tube by pushing on the stub shafts 4 thereby pressing in the bearing plates 7. Then the platen end pieces 8 are pushed into the platen tube 2, followed again by pushing the stub shaft 4 further through the central bore of the platen end piece 8 until the outer free end of the stub shaft 8 is a certain distance from the platen end piece 8. This distance depends on the other design characteristics of the typewriter or printer. At any rate, the distance should be specified so that, in the final assembled state, the knurled section 5 is located in the area of the platen end piece 8. This also determines the distance between the platen end pieces 8 and bearing plates 7.

The platen end pieces 8 may also be provided on the outside with a slotshaped or circular recess to serve as turning driver when grinding the platen shell or cover 3. The platen end pieces 8 as well as the bearing plates 7 may be produced in simple manner of plastic as by injection molding. Since parts 7 and 8 are identical for both the left and right ends of the platen 1, they can be molded in one and the same mold.

In a modification of the design described, the bearing plates 7 and the platen end pieces 8 may also be molded onto the stub shafts 4. The assembly would then vary from the one described inasmuch as the subassemblies consisting of stub shafts 4, bearing plates 7 and platen end pieces 8 would be pressed into the platen type 2 as a unit.

The invention claimed is:

1. A platen adapted to be rotatably supported on a typewriter or like machine comprising:

a hollow cylindrical tube, a pair of stub shaft assemblies adapted to be press-fitted into either end of said tube in axial alignment with the axis of said cylindrical tube, each of said stub shaft assemblies comprising a stub shaft having a knurled portion adapted to non-rotatably engage a bore in the annular end piece, a circular plate having a central depression into which an end of said stub shaft is press fitted and an annular end piece having a central bore for receiving and supporting said stub shaft about a section between its ends, and mounted within and contacting the inner wall of said hollow cylindrical tube and said annular end piece having a flange adapted to abut against the end of said cylindrical tube when the stub shaft assemblies are press fitted into said tube wherein said stub shaft following insertion of said assemblies extends from said annular end piece to said circular plate a distance greater than the diameter of said tube.

2. A platen as recited in claim 1, said tube, said end pieces and circular plates being of plastic material.

3. A platen as recited in claim 1, said tube having a resilient outer cover.

* * * * *